US009727074B1

(12) United States Patent
Terryn

(10) Patent No.: US 9,727,074 B1
(45) Date of Patent: Aug. 8, 2017

(54) BANDGAP REFERENCE CIRCUIT AND METHOD THEREFOR

(71) Applicant: SEMICONDUCTOR COMPONENTS INDUSTRIES, LLC, Phoenix, AZ (US)

(72) Inventor: Steven Terryn, De Pinte (BE)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 15/180,381

(22) Filed: Jun. 13, 2016

(51) Int. Cl.
*G05F 3/04* (2006.01)
*G05F 3/30* (2006.01)

(52) U.S. Cl.
CPC ..... *G05F 3/30* (2013.01)

(58) Field of Classification Search
CPC ..... G05F 3/30; G05F 3/262; G05F 1/465
USPC ..... 323/312–317; 327/538–543
See application file for complete search history.

(56) References Cited

U.S. PATENT DOCUMENTS 4,100,436 A * 7/1978 van de Plassche ..... G05F 3/265 323/315
4,896,094 A 1/1990 Greaves et al.
5,028,881 A 7/1991 Jackson
7,053,694 B2 * 5/2006 Ozawa ..... G05F 3/30 323/313
7,236,048 B1 * 6/2007 Holloway ..... G05F 3/30 327/512
7,453,252 B1 * 11/2008 Megaw ..... G05F 3/30 323/313
2008/0224759 A1 9/2008 Marinca
2009/0284242 A1 * 11/2009 Motz ..... H03F 1/0205 323/313
2011/0043184 A1 2/2011 Zhu
2011/0084681 A1 4/2011 Herbst
2016/0091916 A1 * 3/2016 Chang ..... G05F 1/46 323/268

* cited by examiner

*Primary Examiner* — Nguyen Tran
(74) *Attorney, Agent, or Firm* — Polansky & Associates, P.L.L.C.; Paul J. Polansky

(57) ABSTRACT

A bandgap reference circuit includes a ΔVbe/R circuit portion and an amplification circuit portion. The ΔVbe/R circuit portion has a first and second current path from first and second terminals through first and second bipolar transistors, respectively. The first and second bipolar transistors have different emitter areas and the second path has a resistor. The amplification circuit portion provides a current to each of the first and second terminals of the ΔVbe/R circuit portion and changes the current in response to a voltage difference between the first and second terminals of the ΔVbe/R circuit portion. The ΔVbe/R circuit portion also has first and second base resistors connected to bases of the first and second bipolar transistors, respectively.

20 Claims, 3 Drawing Sheets

BANDGAP REFERENCE CIRCUIT AND METHOD THEREFOR

FIELD

This disclosure relates generally to reference circuit, and more specifically to bandgap voltage reference circuit.

BACKGROUND

Bandgap voltage reference circuits are useful in a wide variety of circuits, such as audio amplifiers, sense amplifiers for memory circuits, analog references, and the like. These bandgap voltage reference circuits are desirable because they provide a reference voltage that is stable over wide ranges of temperature. Many applications require very low noise operation, especially at low frequencies. However, bipolar transistors used in the bandgap voltage reference circuit introduce significant low-frequency noise. If other low-frequency noise sources are minimized, this contribution will dominate low-frequency noise in the circuit.

Figure 1:
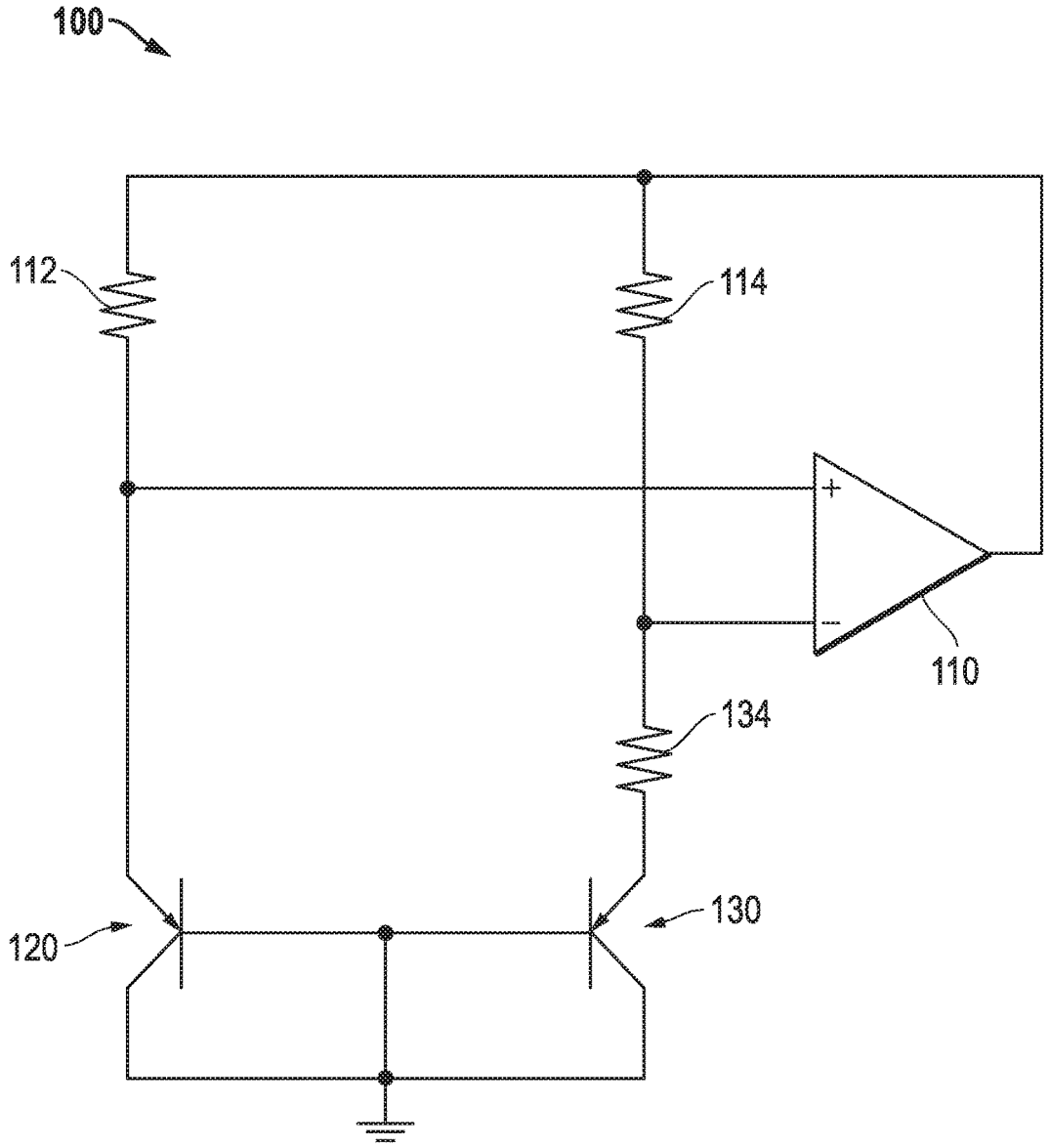
FIG. 1 (Prior Art)
FIG. 1 illustrates in partial schematic form and partial block diagram form a bandgap voltage reference circuit according to the prior art.

In the following description, the use of the same reference numerals in different drawings indicates similar or identical items. Unless otherwise noted, the word "coupled" and its associated verb forms include both direct connection and indirect electrical connection by means known in the art, and unless otherwise noted any description of direct connection implies alternate embodiments using suitable forms of indirect electrical connection as well.

DETAILED DESCRIPTION OF ILLUSTRATIVE EMBODIMENTS

In one form, a bandgap reference circuit includes a first resistor, a first transistor, a second resistor, a third resistor, a second transistor, an amplifier, a first base resistor, and a second base resistor. The first resistor has a first and second terminal. The first transistor has an emitter connected to the second terminal of the first resistor, a base, and a collector connected to a voltage reference terminal. The second resistor has a first terminal connected to the first terminal of the first resistor and a second terminal. The third resistor has a first terminal connected to the second terminal of the second resistor and a second terminal. The second transistor has an emitter connected to the second terminal of the third resistor, a base, and a collector connected to the reference voltage terminal. The amplifier has a first terminal connected to the second terminal of the first resistor, a second terminal connected to the second terminal of the second resistor, and an output connected to the first terminals of the first and second resistors. The first base resistor has a first terminal coupled to the base of the first transistor, and a second terminal connected to the reference voltage terminal. The first base resistor has a resistance set according to a reciprocal of a transconductance of the first transistor. The second base resistor has a first terminal connected to the base of the second transistor, and a second terminal connected to the reference voltage terminal. The second base resistor has a resistance set according to a reciprocal of a transconductance of the second transistor.

In another form, a bandgap reference circuit includes a ΔVbe/R circuit portion and an amplification circuit portion. The ΔVbe/R circuit portion has a first and second current path from first and second terminals through first and second bipolar transistors, respectively. The first and second bipolar transistors have different emitter areas and the second path has a resistor. The amplification circuit portion provides a current to each of the first and second terminals of the ΔVbe/R circuit portion and changes the current in response to a voltage difference between the first and second terminals of the ΔVbe/R circuit portion. The ΔVbe/R circuit portion also has first and second base resistors connected to bases of the first and second bipolar transistors, respectively. In some embodiments, for example, the first and second bipolar transistors are PNP bipolar transistors.

In yet another form, a method includes operating a first bipolar transistor at a first current density, operating a second bipolar transistor at a second current density, providing a current to an emitter of the first bipolar transistor, providing the current to an emitter of the second bipolar transistor through a resistor, changing the current in response to a voltage difference between a voltage at the first emitter of the first transistor and a voltage at the first terminal of the resistor, conducting a first base current from a base of the first bipolar transistor to a reference voltage terminal using a first resistance set according to a reciprocal of a transconductance of the first bipolar transistor, and conducting a second base current from a base of the second bipolar transistor to the reference voltage terminal using a second resistance set according to a reciprocal of a transconductance of the second bipolar transistor. The second bipolar transistor has a different emitter area than the first bipolar transistor.

FIG. 1 illustrates in schematic form a bandgap voltage reference circuit 100 according to the prior art. Bandgap voltage reference circuit 100 includes an operational amplifier 110, a resistor 112, a resistor 114, a PNP bipolar transistor 120, a PNP bipolar transistor 130, and a resistor 134. Operational amplifier 110 includes a non-inverting input, an inverting input, and an output. Resistor 112 has a first terminal connected to the output of operational amplifier 110, and a second terminal connected to the non-inverting input of operation amplifier 110. Resistor 114 has a first terminal connected to the output of operational amplifier 110, and a second terminal connected to the inverting input of operation amplifier 110. The PNP bipolar transistors 120 and 130 have an emitter, a base, and a collector. The emitter of PNP bipolar transistor 120 is connected to the second terminal of resistor 112, and the base and collector of PNP bipolar transistor 120 are connected to a reference voltage terminal. The emitter of PNP bipolar transistor 130 is connected to the second terminal of resistor 134, and the base and collector of PNP bipolar transistor 130 are connected to a reference voltage terminal. Resistor 134 has a first terminal connected to the second terminal of resistor 114, and a second terminal connected to the emitter of PNP bipolar transistor 130. The first terminal of resistor 134 is also connected to inverting input of operational amplifier 110.

In operation, bandgap voltage reference circuit 100 provides a reference voltage that is stable with respect to changes in temperature. It does so by combining a component that is proportional to absolute temperature (PTAT) with a component that is complementary to absolute temperate (CTAT). A voltage proportional to the difference between the base to emitter voltages of the two PNP bipolar transistors 120 and 130, ΔVbe, is developed within the circuit. The ΔVbe voltage developed by the circuit increases with increasing temperature. Bandgap voltage reference circuit 100 also develops a Vbe voltage, which decreases with increasing temperature. Bandgap voltage reference circuit 100 forms a sum of the two voltages that can be used to form a voltage reference that is substantially independent of temperature. When the output voltage is equal to the bandgap of silicon, or about 1.25 volts, the circuit becomes substantially independent of temperature. The PTAT component is from ΔVbe (biased with ratioed current or emitter area) and the result is the thermal voltage, Vt. The CTAT component is from Vbe (biased with constant current). When combining the PTAT and CTAT current components, only linear terms of current are compensated, while higher-order terms are limiting temperature drift.

Assuming use of a low-noise operational transconductance amplifier for operational amplifier 110, most of the remaining low-frequency noise comes from PNP bipolar transistors 120 and 130. Improving the noise contribution from bipolar transistors involves increasing current consumption and/or bipolar transistor area/size, both of which are undesirable. A critical issue in design of bandgap voltage reference circuits is power efficiency and the size of the circuit. A large circuit can be problematic and expensive for integrated circuit design and low power efficiency can be expensive on performance of the integrated circuit. Additionally, at low frequencies, noise from the generation/recombination in the base-emitter junction of the bipolar transistor will dominate over all thermal noise sources in the circuit. 1/f noise current of the transistors flows into a 1/gm impedance at the emitters of the two transistors and generates a noise voltage at the emitters. As voltage at these emitters is used to construct the PTAT part of the bandgap voltage, the noise voltage can contribute quite heavily into total low-frequency noise of the bandgap.

Figure 2:
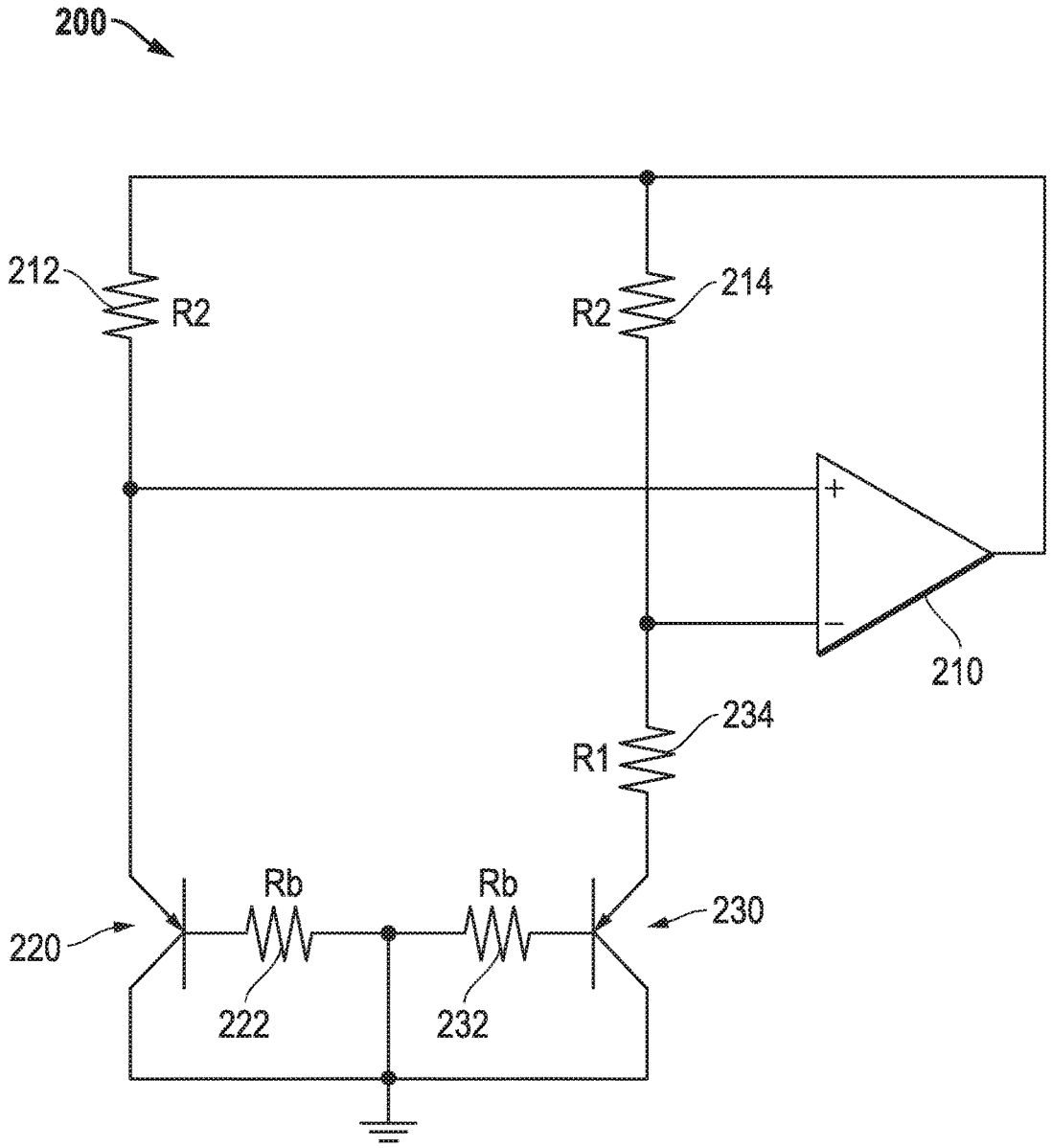
FIG. 2 illustrates in partial schematic form and partial block diagram form a bandgap voltage reference circuit according to some embodiments.

FIG. 2 illustrates in partial schematic form and partial block diagram form a bandgap voltage reference circuit 200 according to some embodiments. Bandgap voltage reference circuit 200 includes an operational amplifier 210, a resistor 212, a resistor 214, a PNP bipolar transistor 220, a resistor 222, a PNP bipolar transistor 230, a resistor 232, and a resistor 234. Operational amplifier 210 includes a non-inverting input, an inverting input, and an output. Resistor 212 has a first terminal connected to the output of operational amplifier 210, and a second terminal connected to the non-inverting input of operation amplifier 210. Resistor 214 has a first terminal connected to the output of operational amplifier 210, and a second terminal connected to the inverting input of operation amplifier 210. PNP bipolar transistor 220 has an emitter connected to the second terminal of resistor 212, a base, and a collector connected to ground. PNP bipolar transistor 230 has an emitter connected to the second terminal of resistor 234, a base, and a collector connected to ground. Resistor 222 has a first terminal connected to the base of PNP bipolar transistor 220, and a second terminal connected to the reference voltage terminal. Resistor 232 has a first terminal connected to the base of PNP bipolar transistor 230, and a second terminal connected to the reference voltage terminal. Resistor 234 has a first terminal connected to the second terminal of resistor 214, and a second terminal connected to the emitter of PNP bipolar transistor 230. The first terminal of resistor 234 is also connected to inverting input of operational amplifier 210.

In operation, bandgap voltage reference circuit 200 also provides a reference voltage that is stable with respect to changes in temperature. Bandgap voltage reference circuit 200 operates substantially the same as bandgap reference circuit 100 of FIG. 1. However, unlike bandgap voltage reference circuit 100 of FIG. 1, bandgap voltage reference circuit 200 has very low noise and therefore is suitable for operation in certain noise-sensitive environments. Resistors 222 and 232 operate to reduce the noise at the emitters of PNP bipolar transistors 220 and 230, and if they are sized as described below, substantially eliminate their noise contributions. Noise contribution from 1/f-noise can be described by Equation 1:

$$V_{n,emitter} = I_{n,be} \times R_b - I_{n,be} \times \frac{1}{g_m} \quad \text{[Equation 1]}$$

in which $V_{n,emitter}$ is the noise voltage at the emitter of transistors 220 or 230, $I_{n,be}$ is the noise current at the base-emitter junction of transistors 220 and 230, and $g_m$ is the transconductance of transistors 220 and 230. Using Equation 1 we can determine that if Rb=1/gm then $V_{n,emitter}=0$. Equation 2 describes current and transconductance in bandgap voltage reference circuit 200 under operating conditions:

$$I = \frac{kT}{q} \times \ln N \times \frac{1}{R_1} = > g_m = \frac{I}{\frac{kT}{q}} = \frac{\ln N}{R_1} \quad \text{[Equation 2]}$$

where N is the ratio of the emitter area of transistor 230 to transistor 220, $R_1$ is the resistance of resistor 234, and $g_m$ is the transconductance of each respective transistor under operating conditions. Substituting the value of $g_m$ from Equation 2 for the value of $R_b$ that cancels noise, the size of $R_b$ can be chosen as in Equation 3:

$$R_b = \frac{1}{g_m} = \frac{1}{\frac{\ln N}{R_1}} = \frac{R_1}{\ln N} \quad \text{[Equation 3]}$$

and substantially no noise voltage is seen at the emitter of the transistors. Thus, substantially no noise from the two transistors will contribute to overall noise in bandgap voltage reference circuit 200. Low-frequency noise reduction is achieved without significant increases in area, power, or design complexity and while being stable over operating conditions.

Figure 3:
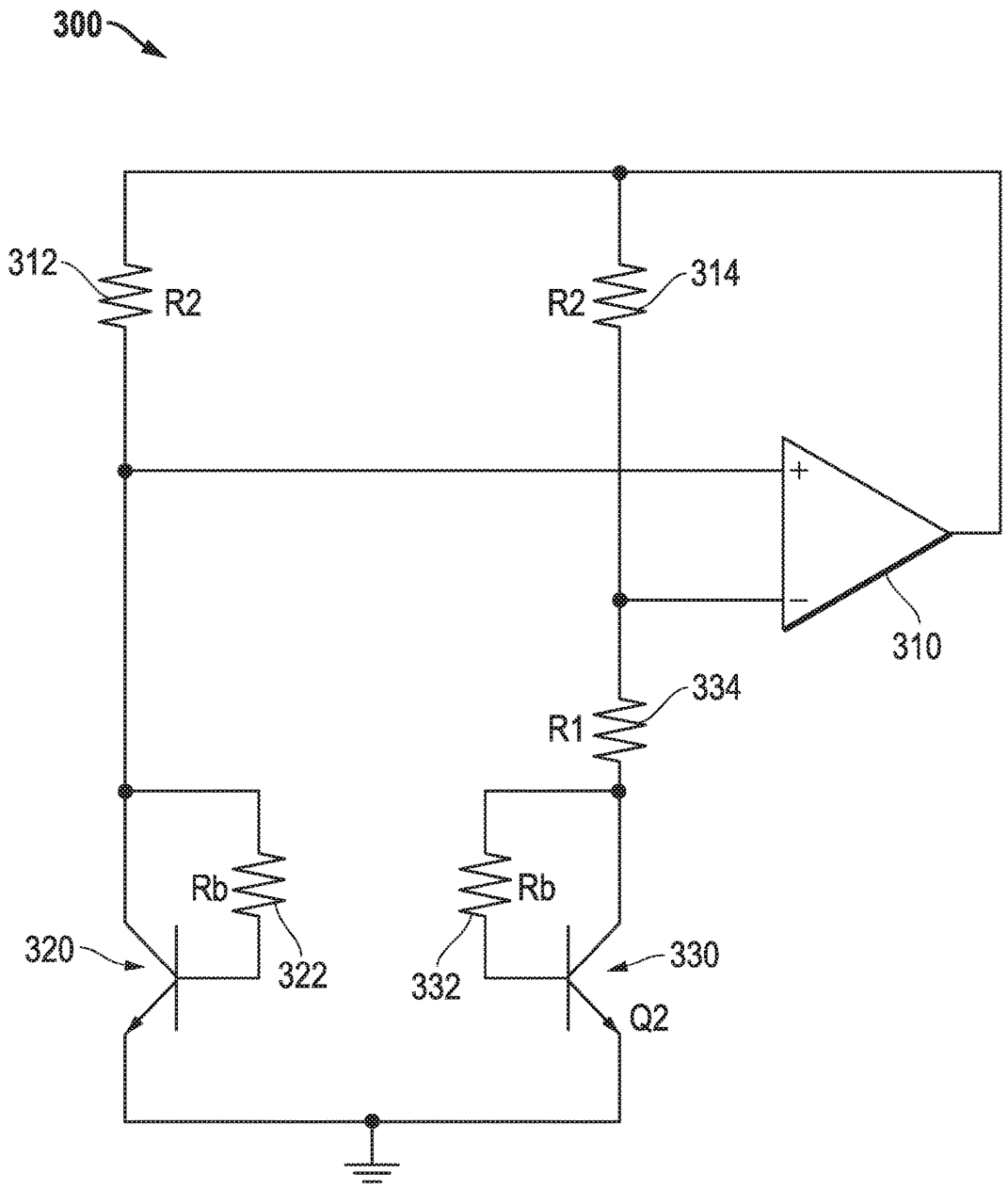
FIG. 3 illustrates in partial schematic form and partial block diagram form a bandgap voltage reference circuit according to other embodiments.

FIG. 3 illustrates in schematic form a bandgap voltage reference circuit 300 according to other embodiments. Bandgap voltage reference circuit 300 includes an operational amplifier 310, a resistor 312, a resistor 314, an NPN bipolar transistor 320, a resistor 322, an NPN bipolar transistor 330, a resistor 332, and a resistor 334. Operational amplifier 310 includes a non-inverting input, an inverting input, and an output. Resistor 312 has a first terminal connected to the output of operational amplifier 310, and a second terminal connected to the non-inverting input of operation amplifier 310. Resistor 314 has a first terminal connected to the output of operational amplifier 310, and a second terminal connected to the inverting input of operation amplifier 310. The NPN bipolar transistors 320 and 330 have an emitter, a base, and a collector. The collector of NPN bipolar transistor 320 is connected to the second terminal of resistor 312, and the emitter of NPN bipolar transistor 320 is connected to a reference voltage terminal. The connector of NPN bipolar transistor 330 is connected to the second terminal of resistor 334, and the emitter of NPN bipolar transistor 330 is connected to a reference voltage terminal. Resistor 322 has a first terminal connected to the base of NPN bipolar transistor 320, and a second terminal connected to the collector of NPN bipolar transistor 320. The second terminal of resistor 322 is also connected to the second terminal of resistor 312. Resistor 332 has a first terminal connected to the base of NPN bipolar transistor 330, and a second terminal connected to the collector of NPN bipolar transistor 330. Resistor 334 has a first terminal connected to the second terminal of resistor 314, and a second terminal connected to the collector of NPN bipolar transistor 330. The first terminal of resistor 334 is also connected to inverting input of operational amplifier 310, and the second terminal is also connected to the second terminal of resistor 332.

In operation, bandgap voltage reference circuit 300 also provides a reference voltage that is stable with respect to changes in temperature with reduced low-frequency noise, but uses NPN transistors.

The above-disclosed subject matter is to be considered illustrative, and not restrictive, and the appended claims are intended to cover all such modifications, enhancements, and other embodiments that fall within the true scope of the claims. For example, in one embodiment, the bandgap voltage reference circuit can be made with PNP transistors as shown in FIG. 2, whereas in another embodiment, the bandgap voltage reference circuit can be made with NPN transistors as shown in FIG. 3. Moreover most noise can be effectively canceled when the resistance of the base resistors is made according to the ratio of the emitter areas of the bipolar transistors and the resistor used to form the ΔVbe/R reference.

Thus, to the maximum extent allowed by law, the scope of the present invention is to be determined by the broadest permissible interpretation of the following claims and their equivalents, and shall not be restricted or limited by the foregoing detailed description.

What is claimed is:

1. A bandgap reference circuit, comprising:

a first resistor having first and second terminals;

a first transistor having an emitter coupled to said second terminal of said first resistor, a base, and a collector coupled to a reference voltage terminal;

a second resistor having a first terminal coupled to said first terminal of said first resistor, and a second terminal;

a third resistor having a first terminal coupled to said second terminal of said second resistor, and a second terminal;

a second transistor having an emitter coupled to said second terminal of said third resistor, a base, and a collector coupled to said reference voltage terminal;

an amplifier having a first terminal coupled to said second terminal of said first resistor, a second terminal coupled to said second terminal of said second resistor, and an output coupled to said first terminals of said first and second resistors;

a first base resistor having a first terminal coupled to said base of said first transistor, and a second terminal coupled to said reference voltage terminal, wherein said first base resistor has a resistance set to be equal to a reciprocal of a transconductance of said first transistor; and a second base resistor having a first terminal coupled to said base of said second transistor, and a second terminal coupled to said reference voltage terminal, wherein said second base resistor has a resistance set to be equal to a reciprocal of a transconductance of said second transistor.

2. The bandgap reference circuit of claim 1 wherein said amplifier is an operational transconductance amplifier.

3. The bandgap reference circuit of claim 2 wherein said operational transconductance amplifier is a chopped operational transconductance amplifier.

4. The bandgap reference circuit of claim 1 wherein said first and second transistors are PNP bipolar transistors.

5. The bandgap reference circuit of claim 1 wherein said first resistor and said second resistor have equal values and said first transistor has an emitter area different from an emitter area of said second transistor.

6. A bandgap reference circuit, comprising:

a ΔVbe/R circuit portion having first and second current paths from first and second terminals through first and second bipolar transistors, respectively, wherein said first and second bipolar transistors have different emitter areas and said second path comprises a resistor; and an amplification circuit portion for providing a current to each of said first and second terminals of said ΔVbe/R circuit portion and changing said current in response to a voltage difference between said first and second terminals of said ΔVbe/R circuit portion, wherein said ΔVbe/R circuit portion further includes first and second base resistors coupled to bases of said first and second bipolar transistors, respectively, said first and second base resistors having resistances set to be equal to a reciprocal of transconductances of said first and second bipolar transistors, respectively.

7. The bandgap reference circuit of claim 6 wherein said first and second bipolar transistors are PNP bipolar transistors.

8. The bandgap reference circuit of claim 7 wherein said first and second base resistors are coupled between said bases of said first and second bipolar transistors and a reference voltage terminal.

9. The bandgap reference circuit of claim 6 wherein said resistor of said second current path comprises:

a first terminal coupled to said emitter of said second bipolar transistor; and a second terminal coupled to said amplification circuit.

10. The bandgap reference circuit of claim 6 wherein said first and second bipolar transistors are NPN bipolar transistors.

11. The bandgap reference circuit of claim 10 wherein said resistor of said second current path comprises:

a first terminal coupled to a collector of said second bipolar transistor; and a second terminal coupled to said amplification circuit.

12. The bandgap reference circuit of claim 10 wherein said first and second bipolar transistors comprise a collector, and wherein said first and second base resistors are coupled between said bases of said first and second bipolar transistors and said collectors of said first and second bipolar transistors.

13. The bandgap reference circuit of claim 6 wherein said amplification circuit portion comprises an operational transconductance amplifier.

14. The bandgap reference circuit of claim 6 further comprising:

a first resistor having a first and second terminal; and a second resistor having a first and second terminal;

wherein said first terminal of said first resistor is coupled to said first terminal of said ΔVbe/R circuit portion and a first input of said amplification circuit portion and said second terminal of said first resistor is coupled to an output of said amplification circuit portion; and wherein said first terminal of said second resistor is coupled to said second terminal of said ΔVbe/R circuit portion and an input of said amplification circuit portion and said second terminal of said second resistor is coupled to said output of said amplification circuit portion.

15. A method comprising:

operating a first bipolar transistor at a first current density;

operating a second bipolar transistor having a different emitter area than said first bipolar transistor at a second current density;

providing a current to an emitter of said first bipolar transistor;

providing said current to an emitter of said second bipolar transistor through a resistor having a first terminal and a second terminal coupled to an emitter of said second bipolar transistor;

changing said current in response to a voltage difference between a voltage at said first emitter of said first transistor and a voltage at said first terminal of said resistor;

conducting a first base current from a base of said first bipolar transistor to a reference voltage terminal using a first resistance set to be equal to a reciprocal of a transconductance of said first bipolar transistor; and conducting a second base current from a base of said second bipolar transistor to said reference voltage terminal using a second resistance set to be equal to a reciprocal of a transconductance of said second bipolar transistor.

16. The method of claim 15 wherein said current to said emitter of said first bipolar transistor and said current to said emitter of said second bipolar transistor is provided by an operational transconductance amplifier.

17. The method of claim 15 wherein said first and second bipolar transistors are PNP bipolar transistors.

18. The method of claim 15 wherein said first and second bipolar transistors are NPN bipolar transistors.

19. The method of claim 15 wherein said first bipolar transistor and said second bipolar transistor are parasitic bipolar transistors.

20. The method of claim 15 wherein said first and second resistance is a resistance of said resistor divided by a natural log of a ratio of an area of said emitter of said first bipolar transistor and an area of said emitter of said second bipolar transistor.

* * * * *